US011421702B2

(12) United States Patent
Nichols

(10) Patent No.: US 11,421,702 B2
(45) Date of Patent: Aug. 23, 2022

(54) IMPELLER WITH CHORDWISE VANE THICKNESS VARIATION

(71) Applicant: PRATT & WHITNEY CANADA CORP., Longueuil (CA)

(72) Inventor: Jason Nichols, Mississauga (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 251 days.

(21) Appl. No.: 16/546,781

(22) Filed: Aug. 21, 2019

(65) Prior Publication Data

US 2021/0054849 A1 Feb. 25, 2021

(51) Int. Cl.

| | |
|---|---|
| ***F04D 29/24*** | (2006.01) |
| ***F04D 29/28*** | (2006.01) |
| ***F04D 29/30*** | (2006.01) |
| ***F04D 29/44*** | (2006.01) |

(52) U.S. Cl.

CPC ..... *F04D 29/242* (2013.01); *F04D 29/284* (2013.01); *F04D 29/30* (2013.01); *F04D 29/441* (2013.01)

(58) Field of Classification Search

CPC ..... F04D 29/242; F04D 29/284; F04D 29/30; F04D 29/441; F04D 29/324; F05D 2240/304

See application file for complete search history.

(56) References Cited

U.S. PATENT DOCUMENTS

| | | | |
|---|---|---|---|
| 2,819,838 | A | 1/1958 | Warner |
| 3,412,978 | A | 11/1968 | Keenan et al. |
| 4,696,621 | A | 9/1987 | Hamblett et al. |
| 7,497,664 | B2 | 3/2009 | Walter et al. |
| 8,057,188 | B2 | 11/2011 | Parker et al. |
| 8,171,632 | B2 | 5/2012 | Kuehhorn et al. |
| 8,449,261 | B2 | 5/2013 | Kappis et al. |
| 8,573,945 | B2 | 11/2013 | Wang et al. |
| 8,596,986 | B2 | 12/2013 | Miller et al. |

(Continued)

FOREIGN PATENT DOCUMENTS

| | | | |
|---|---|---|---|
| CN | 2782936 | Y | 5/2006 |
| CN | 100370148 | C | 2/2008 |

(Continued)

OTHER PUBLICATIONS

Kim et al, Study on the performance of a centrifugal compressor considering running tip clearance, 2016 (Year: 2016).*

(Continued)

*Primary Examiner* — Sabbir Hasan

(74) *Attorney, Agent, or Firm* — Norton Rose Fulbright Canada LLP

(57) ABSTRACT

An impeller for a centrifugal compressor, the impeller comprising: a hub defining a rotation axis about which the impeller is rotatable; and a vane extending from the hub, the vane having a leading edge, a trailing edge, and a chord defined therebetween, a pressure side of the vane and a suction side of the vane opposite the pressure side, a vane thickness defined transversely between the pressure side and the suction side, the vane thickness reducing over at least a downstream 40% of the chord, the vane thickness having a trailing edge thickness value at the trailing edge of between 40% and 80% of a maximum thickness value of the vane thickness.

20 Claims, 5 Drawing Sheets

(56) References Cited

U.S. PATENT DOCUMENTS

| | | | | |
|---|---|---|---|---|
| 9,011,081 | B2 | 4/2015 | Gomez et al. | |
| 9,046,111 | B2 | 6/2015 | Harvey et al. | |
| 9,222,485 | B2 | 12/2015 | Brown et al. | |
| 9,506,347 | B2 | 11/2016 | Key | |
| 9,759,230 | B2 | 9/2017 | Heikurinen et al. | |
| 9,803,652 | B2 * | 10/2017 | Duong | F04D 29/681 |
| 9,845,684 | B2 | 12/2017 | Warikoo et al. | |
| 9,926,938 | B2 | 3/2018 | Yokoyama et al. | |
| 10,002,209 | B2 | 6/2018 | Cellier et al. | |
| 10,006,297 | B2 | 6/2018 | Yoshida et al. | |
| 10,253,633 | B2 | 4/2019 | Klaus et al. | |
| 2006/0067829 | A1 * | 3/2006 | Vrbas | F04D 29/284 416/223 R |
| 2008/0298974 | A1 | 12/2008 | Guemmer | |
| 2015/0056910 | A1 | 2/2015 | Ikeda et al. | |
| 2016/0061042 | A1 | 3/2016 | Duong et al. | |
| 2016/0222980 | A1 | 8/2016 | Scotti Del Greco et al. | |
| 2016/0252101 | A1 | 9/2016 | Rubino et al. | |
| 2017/0306971 | A1 | 10/2017 | Yamashita et al. | |
| 2018/0066522 | A1 | 3/2018 | Warikoo et al. | |
| 2018/0119555 | A1 | 5/2018 | Vogiatzis et al. | |
| 2018/0119706 | A1 | 5/2018 | Vogiatzis | |
| 2019/0032671 | A1 | 1/2019 | Woiczinski | |
| 2019/0085700 | A1 | 3/2019 | Pernleitner et al. | |

FOREIGN PATENT DOCUMENTS

| | | | |
|---|---|---|---|
| CN | 101341312 | B | 1/2012 |
| CN | 101743405 | B | 8/2012 |
| CN | 105332946 | A | 2/2016 |
| CN | 104136736 | B | 10/2016 |
| CN | 102472111 | B | 3/2017 |
| CN | 104471190 | B | 7/2017 |
| CN | 107092763 | A | 8/2017 |
| CN | 108087328 | A | 5/2018 |
| CN | 108167226 | A | 6/2018 |
| CN | 108180164 | A | 6/2018 |
| CN | 108194412 | A | 6/2018 |
| CN | 104937236 | B | 10/2018 |
| CN | 108916113 | | 11/2018 |
| CN | 107061368 | B | 12/2018 |
| CN | 105723094 | B | 2/2019 |
| CN | 106640210 | B | 3/2019 |
| EP | 270723 | B1 | 6/1988 |
| EP | 798447 | B1 | 9/2001 |
| EP | 1741935 | B1 | 1/2010 |
| EP | 2462320 | B1 | 10/2016 |
| EP | 2877701 | B1 | 5/2017 |
| EP | 2360377 | B1 | 11/2017 |
| EP | 2960462 | B1 | 1/2019 |
| EP | 3026214 | B1 | 4/2019 |
| FR | 2944049 | B1 | 6/2014 |
| IN | 201500867 | I2 | 10/2017 |
| JP | 9068197 | A | 3/1997 |
| JP | 2002021785 | A | 1/2002 |
| JP | 04146284 | B2 | 9/2008 |
| JP | 2009243394 | A | 10/2009 |
| JP | 2012241564 | A | 12/2012 |
| JP | 05221985 | B2 | 6/2013 |
| JP | 2014001687 | A | 1/2014 |
| JP | 05705337 | B2 | 4/2015 |
| JP | 05964081 | B2 | 8/2016 |
| JP | 06025961 | B2 | 11/2016 |
| JP | 2018138786 | A | 9/2018 |
| JP | 06430032 | B2 | 11/2018 |
| KR | 910439 | B1 | 8/2009 |
| KR | 1290905 | B1 | 7/2013 |
| KR | 1541435 | B1 | 8/2015 |
| WO | 201907355 | A1 | 4/2019 |
| WO | 2019097611 | A1 | 5/2019 |
| WO | 2019127870 | A1 | 7/2019 |

OTHER PUBLICATIONS

European Search Report issued for Application No. 20191813.3 dated Jan. 20, 2021.

Kim Changhee et al: "Study on the performance of a centrifugal compressor considering running tip clearance", International Journal of Refrigeration, Elsevier, Amsterdam, NL, vol. 65, Jan. 4, 2016, pp. 92-102, XP029539720.

Tomoki: Kawakubo et al.: "Development of a High-Flow centrifugal Compressor Stage", Dec. 31, 2018, XP055761319.

* cited by examiner

IMPELLER WITH CHORDWISE VANE THICKNESS VARIATION

TECHNICAL FIELD

The application relates generally to centrifugal compressors of gas turbine engines and, more particularly, to an impeller of such centrifugal compressors.

BACKGROUND OF THE ART

Centrifugal compressors generally consist of at least two main components: an impeller and a diffuser. The impeller includes a hub which it is mounted to a drive shaft so as to be rotated therewith. Vanes (i.e., blades) of the impeller extend from the hub and are arranged to redirect an axially-directed inbound gas flow radially outwardly, toward the diffuser located downstream of the impeller. Stresses may however be imparted on the impeller, often in or near the hub. Such stress concentrations may adversely affect the life of the impeller. At the same time, vane bulk is generally regarded as being detrimental to aerodynamic properties of the flow passed from the impeller to the diffuser, thus rendering oversizing approaches undesirable in solving the issue of stress concentration. As such, there continues to be a need for improvement.

SUMMARY

In one aspect, there is provided an impeller for a centrifugal compressor, the impeller comprising: a hub defining a rotation axis about which the impeller is rotatable; and a vane extending from the hub, the vane having a leading edge, a trailing edge, and a chord defined therebetween, a pressure side of the vane and a suction side of the vane opposite the pressure side, a vane thickness defined transversely between the pressure side and the suction side, the vane thickness reducing over at least a downstream 40% of the chord, the vane thickness having a trailing edge thickness value at the trailing edge of between 40% and 80% of a maximum thickness value of the vane thickness.

In another aspect, there is provided a centrifugal compressor for a turbine engine, the centrifugal compressor comprising: a diffuser configured to be disposed downstream of an inlet case of the turbine engine; and an impeller upstream of the diffuser, the impeller including a hub and a vane extending from the hub, the vane having a leading edge, a trailing edge and a chord defined therebetween, a pressure side of the vane and a suction side of the vane opposite the pressure side, a vane thickness defined transversely between the pressure side and the suction side, the vane thickness reducing over at least a downstream 40% of the chord, the vane thickness having a trailing edge thickness value at the trailing edge of between 40% and 80% of a maximum thickness value of the vane thickness.

In a further aspect, there is provided a turbine engine for an aircraft, the turbine engine comprising: an inlet; and a centrifugal compressor disposed downstream of the inlet, the centrifugal compressor including an impeller and a diffuser downstream of the impeller, the impeller including a hub and a vane extending from the hub, the vane having a leading edge, a trailing edge and a chord defined therebetween, a pressure side of the vane and a suction side of the vane opposite the pressure side, a vane thickness defined transversely between the pressure side and the suction side, the vane thickness reducing over at least a downstream 40% of the chord, the vane thickness having a trailing edge thickness value at the trailing edge of between 40% and 80% of a maximum thickness value of the vane thickness.

BRIEF DESCRIPTION OF THE DRAWINGS

Reference is now made to the accompanying figures in which.

DETAILED DESCRIPTION

Figure 1:
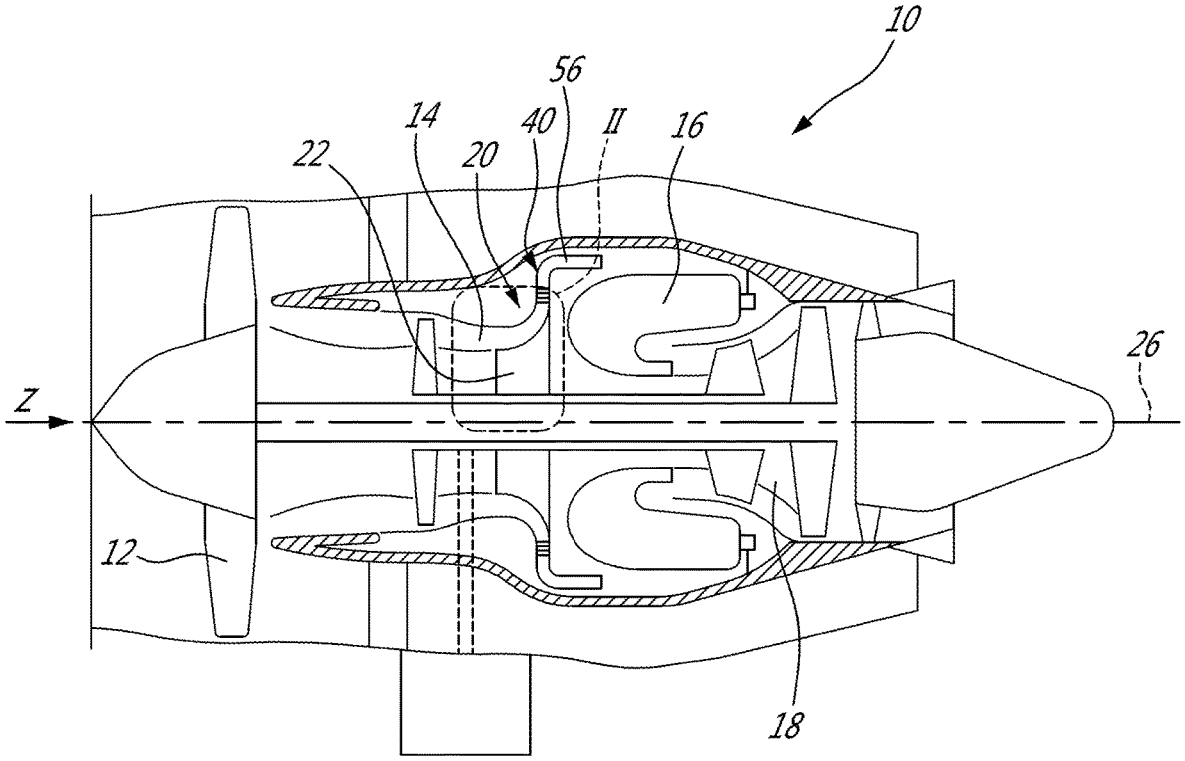
FIG. 1 is a schematic cross-sectional view of a gas turbine engine.

FIG. 1 illustrates a gas turbine engine 10 of a type preferably provided for use in transonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. Although the engine 10 is a turbofan gas turbine engine 10, it should be understood that the present technology is also applicable to other types of gas turbine engine. Of particular interest to the instant application, the compressor section 14 includes at least one centrifugal compressor assembly 20, including generally an impeller 22 and a diffuser 40 downstream of the impeller 22.

Figure 2:
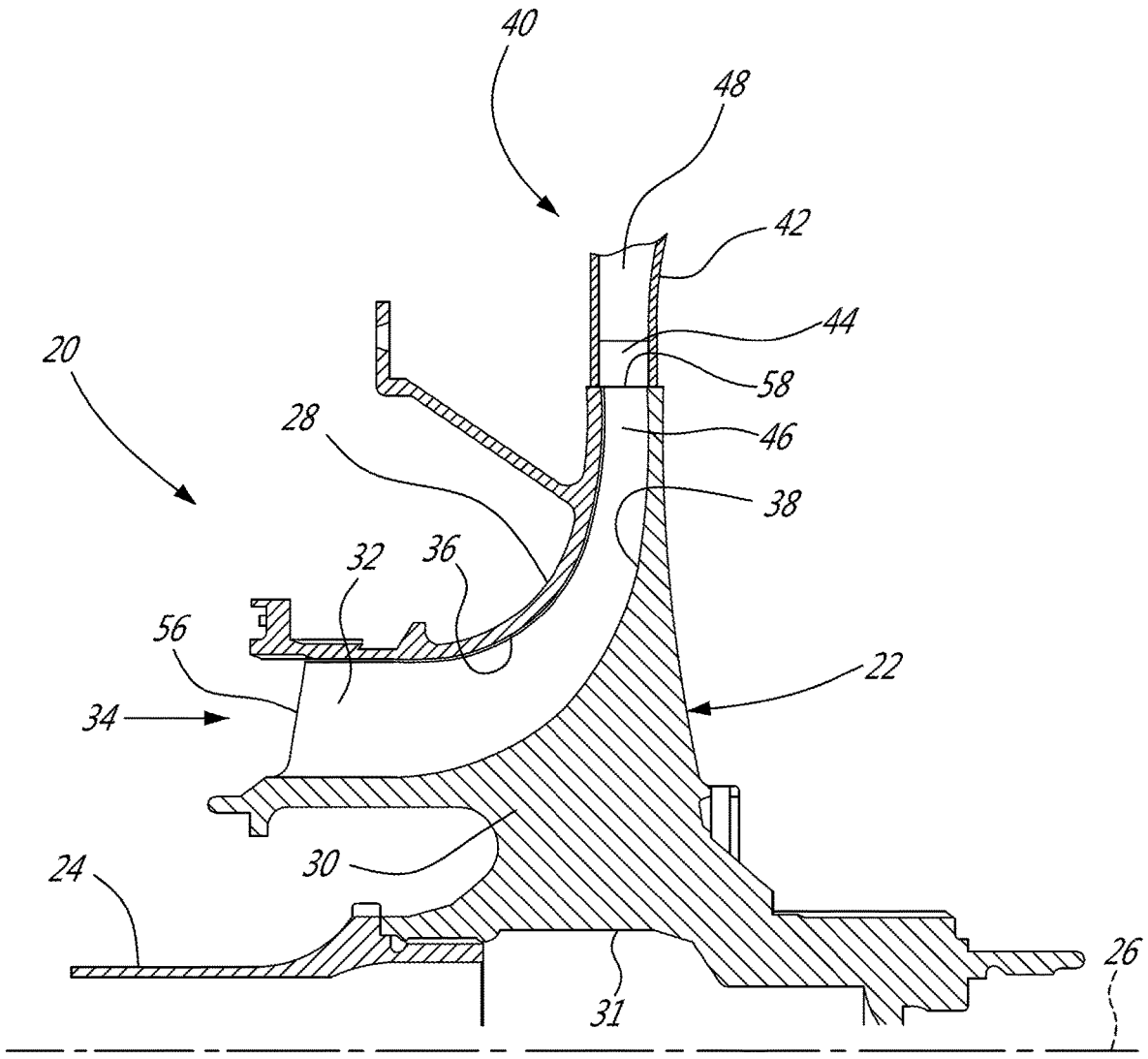
FIG. 2 is an enlarged cross-sectional view of a portion of a centrifugal compressor of the gas turbine engine of FIG. 1, taken from region II in FIG. 1, having an impeller and a downstream diffuser.

Referring to FIG. 2, the centrifugal compressor assembly 20 includes impeller 22 fixed to a central shaft 24 and rotatable with the shaft 24 about a central axis 26 within a stationary impeller shroud 28 of the compressor assembly 20. The impeller 22 comprises a central hub 30 defining a bore 31 therethrough that is collinear with the axis 26. The impeller 22 also comprises a plurality of vanes 32 disposed around the hub 30 and bore 31, and extending radially outwardly thereof to define a radial periphery of the impeller 22. The vanes 32 and the surrounding shroud 28 are shaped to redirect an incoming axially-flowing fluid flow 34, radially outward by about ninety degrees, forcing the fluid flow 34 radially outwardly relative to the hub 30, and increasing the velocity of the fluid flow 34. Although it is not essential, the hub 30 and the plurality of vanes 32 form in some embodiments a unitary piece. An annular fluid path is thus defined through the compressor assembly 20, along and through the vanes 32, between an inner surface 36 of the impeller shroud 28 and an outer surface 38 of the hub 30.

Figure 3:
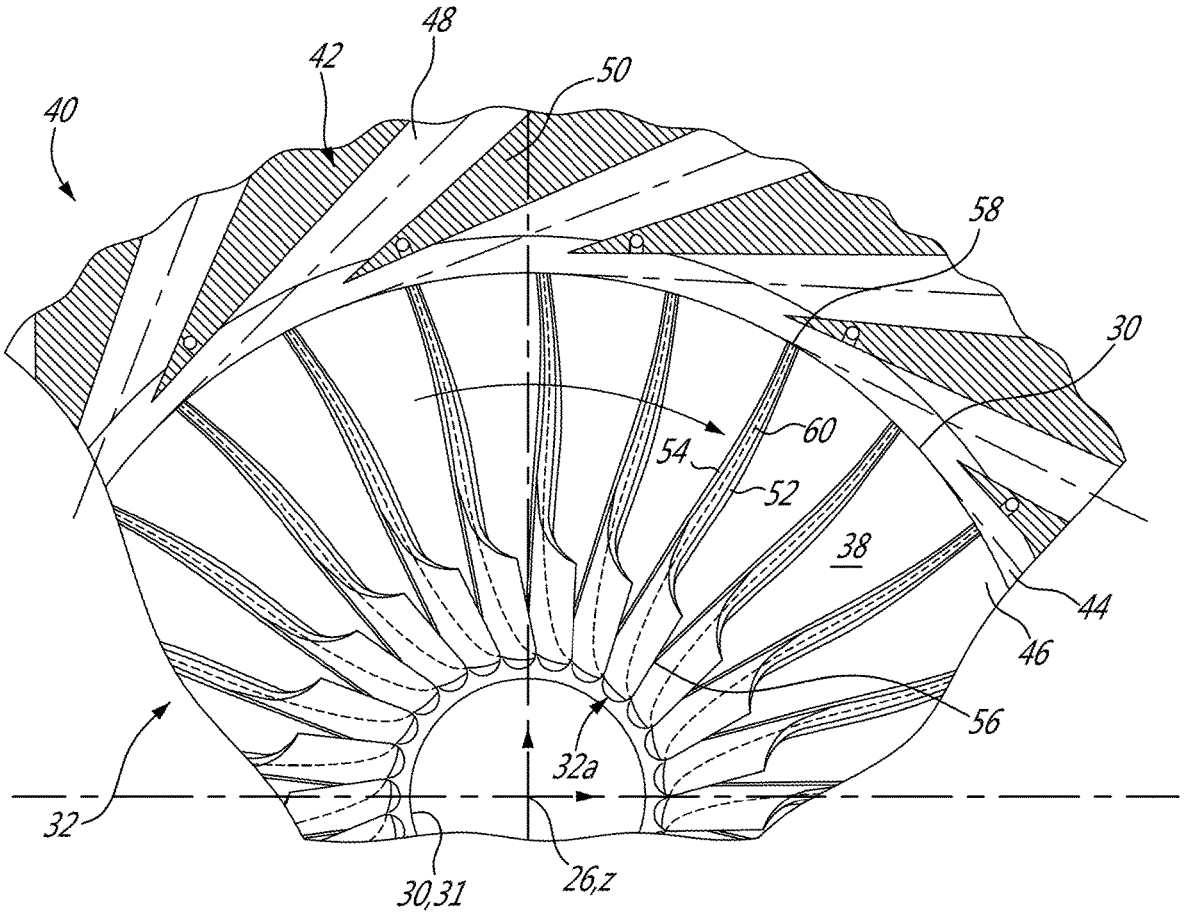
FIG. 3 is a partial transverse cross-sectional view of a portion of the centrifugal compressor of FIG. 2, viewed along the direction Z of a longitudinal central axis of the gas turbine engine.

Still referring to FIG. 2, the diffuser 40 includes a diffuser case 42 defining a circumferential inlet space 44 surrounding a periphery of an outlet space 46 of the compressor assembly 20. As best seen in FIG. 3, the diffuser 40 includes a series of angled passages 48 are defined through the diffuser case 42 from the inlet space 44, each passage 48 being defined between adjacent diffuser vanes or vane islands 50 (FIG. 3). The diffuser 40 can be a vane type diffuser or may comprise a plurality of diffuser pipes. Alternate diffuser geometries are also possible, including for example a diffuser with a vaneless inlet space. Although it is not essential, the diffuser case 42 is in one particular embodiment a unitary machined part.

Turning now to FIG. 3, the vanes 32 will now be described in more detail with regard to a vane 32*a* of the vanes 32 of the impeller. It should be understood that the present description of the vane 32*a* is consistent, mutatis mutandis, with a remainder of the vanes 32 of the impeller 22. The vane 32*a* has a pressure side 52 and a suction side 54, opposite from one another. The pressure and suction sides 52, 54 extend from the outer surface 38 of the hub 30, thereby defining a root of the vane 32*a* formed at the junction between the outer surface 38 of the hub 30 and the pressure and suction surfaces 52, 54 of the vane 32*a*. The vane 32*a* extends from its root to an outer free end of the vane 32*a*, which is spaced apart from the outer surface 38 to define a height of the vane at a given chord position. The vane 32*a* also has a leading edge 56 and a trailing edge 58. The leading and trailing edges 56, 58 extend from the root to the free end of the vane 32*a*, at the junctions between the pressure surface 52 and the suction surface 54. The leading edge 56 forms an upstream end of the vane 32*a*. As best seen in FIG. 3, in some embodiments, the pressure and suction sides 52, 54 converge so as to define the leading edge 56. The trailing edge 58 forms a downstream end of the vane.

The true chord 60 of the vane 32*a* is defined as the chord line that extends between the leading and trailing edges 56, 58, following the pressure and/or suction sides 52, 54 of the vane airfoil, and measured at the hub 30 (i.e. at the junction between the pressure or suction side of the vane and the outer surface 38 of the hub 30. In FIG. 3, the chord 60 is shown as extending at the root of the vane 32*a*, intermediate the pressure and suction sides 52, 54. In other embodiments, the chord 60 may otherwise follow the vane 32*a* alongside either one of its pressure side 52 or its suction side 54, at either one of the root and the free end. A vane thickness is defined between the pressure side 52 and the suction side 54. The vane thickness is measurable transversely to the chord 60 between the pressure and suction sides 52, 54, at the root of the vane 32*a*. In other embodiments, the vane thickness may be instead measured at the outer free end of the vane 32*a*. The vane thickness includes a trailing edge thickness value, measured at the trailing edge 58, and a maximum thickness value located at a point on the vane upstream from the trailing edge. The maximum thickness value is greater than the trailing edge thickness value. From FIG. 3, it can be appreciated that the portion of the vane 32*a* having the maximum thickness value is substantially upstream of the trailing edge 58, and in fact the maximum thickness value may be disposed within the upstream half of the vane. As will be seen, the vane 32*a* of the impeller 20 has a vane thickness that reduces non-negligibly over a downstream portion of the vane 32*a*.

Figure 4:
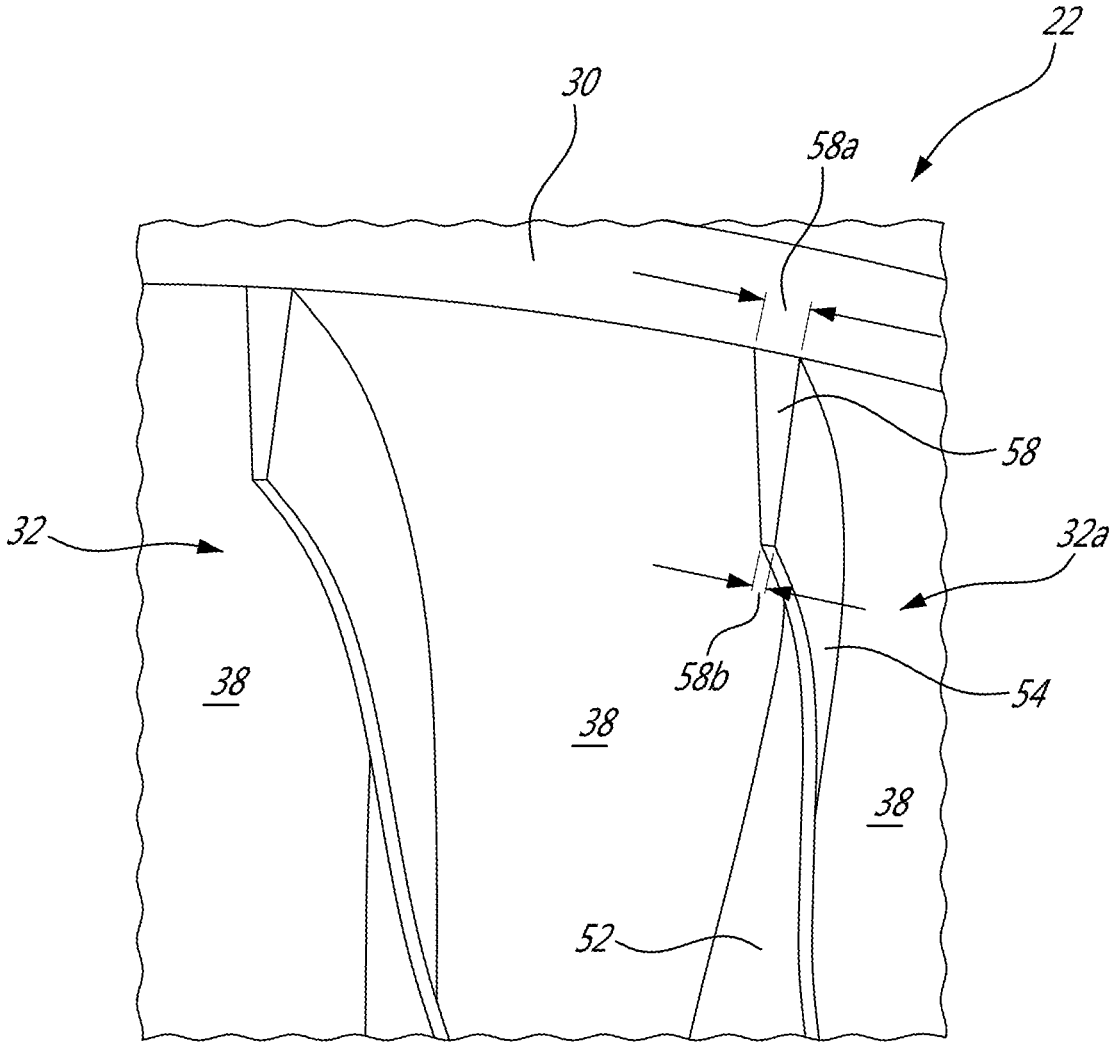
FIG. 4 is a perspective schematic view of a portion of the impeller of FIG. 3.

As best seen in FIG. 4, at the trailing edge 58, the pressure and suction sides 52, 54 are spaced apart by a distance 58*a* corresponding to the trailing edge thickness value of the vane 32*a* at the hub 30. At the outer free end of the vane 32*a*, away from the hub, the pressure and suction sides 52, 54 are spaced apart by a distance 58*b* which may, at the trailing edge 58, be less than the trailing edge thickness value 58*a* at the hub, such as in the one embodiment shown. In this one embodiment, a second vane thickness of the vane 32*a* measured at the free end is substantially constant over the downstream portion of the chord 60. In other embodiments, the second vane thickness may vary over the downstream portion of the chord 60.

Figure 5:
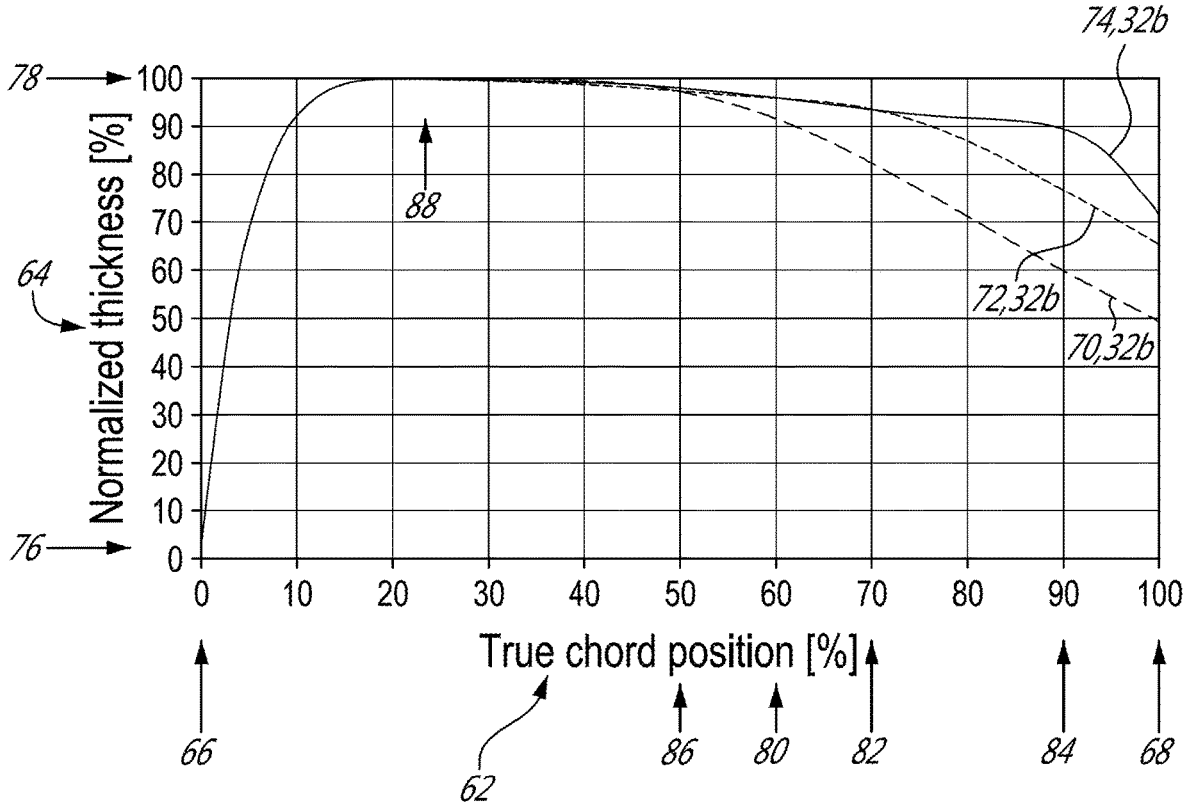
FIG. 5 is a graph illustrating impeller chordwise vane thickness variations.

Turning now to FIG. 5, a graph is provided so as to describe the vane thickness of the vane 32*a* in more detail by means of specific examples of vanes 32*b* consistent with various embodiments of the present technology. The graph depicts vane thickness as a function of a chordwise position of the vanes 32*b*. At several estimated true chord positions 62 of each one of the vanes 32*b* (i.e., locations on the vane expressed as percentages of the chord 60) estimates of normalized thickness values 64 (i.e., measured thickness values expressed as percentages of the maximum thickness value) are plotted. Each of the curves 70, 72, 74 depicted in the graph of FIG. 5 therefore represents a vane 32*b* in accordance with a different embodiment of the present technology. It is however to be understood that each of these curves is exemplary in nature, and that other vane thickness profiles can be used without departing from the scope of the present disclosure. In the graph of FIG. 5, the 0% chord position 66 of the true chord positions 62 corresponds to the leading edges 56 of the vanes 32*b*, and the 100% chord position 68 of the true chord positions 62 corresponds to the trailing edges 58 of the vanes 32*b*.

In the graph, vane thicknesses of the vanes 32*b* are respectively depicted by curves 70, 72 and 74. In some embodiments, at the 0% chord position 66, the vane thickness has vane thickness value being a minimum thickness value 76 of the vane 32*a*. In some such embodiments, at the 0% chord position 66, the vane thickness has vane thickness value corresponding to less than 10% (and in one particular embodiment about 5%) of the maximum thickness value (shown at 78).

From the graph, it can be appreciated that the vane thickness reduces over at least a downstream 40% of the chord, i.e., downstream from a 60% chord position 80 to the 100% chord position at the trailing edge 58.

At the 60% chord position 80, the vane thickness has a thickness value of between about 90% and 100% of the maximum thickness value 78, and more particularly between about 90% and about 97% of the maximum thickness value 78. For instance, in the embodiments depicted by the curves 70, 72 and 74, the vanes have thickness values of approximately 92%, 96% and 96% at the 60% chord position, respectively.

At a 70% chord position 82, the vane thickness has a thickness value of between about 80% and about 95% of the maximum thickness value 78. For instance, in the embodiments depicted by the curves 70, 72 and 74 indicate thickness values of approximately 83%, 93% and 93%, respectively.

At a 90% chord position 84, the vane thickness has a thickness value of between about 50% and 95% of the maximum thickness value 78, and more particularly between about 55% and 90%. For instance, the curves 70, 72 and 74 indicate thickness values of approximately 60%, 77% and 90%, respectively.

At the 100% chord position 68, i.e. at the trailing edge of the vane, the vane thickness has a thickness value of between 40% and 80% of the maximum thickness value 78, and more particularly between 45% and 75% of the maximum thickness value 78. For instance, the curves 70, 72 and 74 indicate trailing edge thickness values of approximately 50%, 66% and 73%, respectively.

In some embodiments, the maximum thickness value 78 may be at a position upstream of a 50% chord position 86, or in other words within the upstream half of the vanes. For instance, the curves 70, 72 and 74 are indicative of their respective maximum thickness values 78 being generally between a 15% chord position and a 40% chord position.

In light of the preceding, it can be appreciated that a chordwise reduction in thickness of the vanes 32, 32*a*, 32*b* as disclosed herein can result in an impeller 22 having a greater life when compared to some conventional impellers. The reduction in thickness of the vanes 32, 32*a*, 32*b* over at least the downstream 40% of the chord 60 is arranged so as to impart the impeller 22 with a desired resistance to stress at the bore 31 under certain operating conditions. For instance, the reduction in thickness results in a distribution of a mass of the vanes 32, 32*a*, 32*b* as they extend away from their root, yielding a desired inertial load at the root. Upstream of the reduction, a bulging 88 of the vanes 32, 32*a*, 32*b* inclusive of the portion thereof having the maximum vane thickness value 78 yields a desired resistance to stress concentration typically borne by conventional impellers. It should also be understood that the vanes 32, 32*a*, 32*b* are also arranged so as to impart the impeller 22 with certain desired aerodynamic properties. For instance, in some embodiments, the reduction in thickness of the vanes 32, 32*a*, 32*b* over at least the downstream 40% of the chord 60 is arranged such that, under certain operating conditions, the flow 34 is imparted with a desired maximum amount of disturbance upon moving downstream from the trailing edge 58. In some embodiments, a geometry of the vanes 32, 32*a*, 32*b* over at least the downstream 40% of the chord 60 may be configured with respect to a shape of the corresponding diffuser 40.

The above description is meant to be exemplary only, and one skilled in the art will recognize that changes may be made to the embodiments described without departing from the scope of the invention disclosed. For example, the impellers can be provided in centrifugal compressors of other types of turbine engines than that described herein. Fluids passed downstream of the impellers can be collected by other types of structures than the diffusers described. Still other modifications which fall within the scope of the present invention will be apparent to those skilled in the art, in light of a review of this disclosure, and such modifications are intended to fall within the appended claims.

The invention claimed is:

1. An impeller for a centrifugal compressor, the impeller comprising:

a hub defining a rotation axis about which the impeller is rotatable; and a vane extending from the hub, the vane having a leading edge, a trailing edge, and a chord defined therebetween, a pressure side of the vane and a suction side of the vane opposite the pressure side, a vane thickness defined transversely between the pressure side and the suction side, the vane thickness reducing over at least a downstream 40% of the chord, the vane thickness at the hub having a trailing edge thickness value at the trailing edge of between 40% and 70% of a maximum thickness value of the vane thickness at the hub.

2. The impeller as claimed in claim 1, wherein a 0% chord position is defined at the leading edge and a 100% chord position is defined at the trailing edge, the trailing edge thickness value being a thickness value at the 100% chord position, the thickness value at the 100% chord position is between 45% and 70% of the maximum thickness value.

3. The impeller as claimed in claim 2, wherein the thickness value at the 100% chord position is of between 50% and 70% of the maximum thickness value.

4. The impeller as claimed in claim 3, wherein the thickness value at the 100% chord position is of between 60% and 70% of the maximum thickness value.

5. The impeller as claimed in claim 4, wherein the thickness value at the 100% chord position is of between 65% and 70% of the maximum thickness value.

6. The impeller as claimed in claim 2, wherein the thickness value at the 100% chord position is of between 45% and 55% of the maximum thickness value.

7. The impeller as claimed in claim 2, wherein the vane thickness has a thickness value at a 90% chord position of between 50% and 90% of the maximum thickness value.

8. The impeller as claimed in claim 7, wherein the thickness value at the 90% chord position is of between 55% and 80% of the maximum thickness value.

9. The impeller as claimed in claim 8, wherein the thickness value at the 90% chord position is of between 55% and 65% of the maximum thickness value.

10. The impeller as claimed in claim 8, wherein the thickness value at the 90% chord position is of between 70% and 80% of the maximum thickness value.

11. The impeller as claimed in claim 7, wherein the thickness value at the 90% chord position is of between 85% and 90% of the maximum thickness value.

12. The impeller as claimed in claim 1, wherein the maximum thickness value is within an upstream 50% of the chord.

13. A centrifugal compressor for a turbine engine, the centrifugal compressor comprising:

a diffuser configured to be disposed downstream of an inlet case of the turbine engine; and an impeller upstream of the diffuser, the impeller including a hub and a vane extending from the hub, the vane having a leading edge, a trailing edge and a chord defined therebetween, a pressure side of the vane and a suction side of the vane opposite the pressure side, a vane thickness defined transversely between the pressure side and the suction side, the vane thickness reducing over at least a downstream 40% of the chord, the vane thickness having a trailing edge thickness value at the trailing edge of between 65% and 70% of a maximum thickness value of the vane thickness.

14. The centrifugal compressor as claimed in claim 13, wherein a thickness value at a 90% chord is of between 50% and 90% of the maximum thickness value.

15. The centrifugal compressor as claimed in claim 14, wherein the thickness value at the 90% chord is of between 55% and 65% of the maximum thickness value.

16. The centrifugal compressor as claimed in claim 13, wherein the maximum thickness value is within an upstream 50% of the chord.

17. A turbine engine for an aircraft, the turbine engine comprising:

an inlet; and a centrifugal compressor disposed downstream of the inlet, the centrifugal compressor including an impeller and a diffuser downstream of the impeller, the impeller including a hub and a vane extending from the hub, the vane having a leading edge, a trailing edge and a chord defined therebetween, a pressure side of the vane and a suction side of the vane opposite the pressure side, a vane thickness defined transversely between the pressure side and the suction side, the vane thickness reducing over at least a downstream 40% of the chord, the vane thickness having a trailing edge thickness value at the trailing edge of between 40% and 75% of a maximum thickness value of the vane thickness, wherein a 0% chord position is defined at the leading edge and a 100% chord position is defined at the trailing edge, the trailing edge thickness value being a thickness value at the 100% chord position, the thickness value at a 90% chord position is of between 55% and 65% of the maximum thickness value.

18. The turbine engine as claimed in claim 17, wherein a 0% chord position is defined at the leading edge and the 100% chord position is defined at the trailing edge, the vane thickness has a thickness value at the 100% chord position of between 45% and 75% of the maximum thickness value.

19. The turbine engine as claimed in claim 18, wherein the trailing edge thickness value is taken at the hub.

20. The centrifugal compressor as claimed in claim 17, wherein the maximum thickness value is within an upstream 50% of the chord.

* * * * *